US007526836B2

(12) United States Patent
Migli

(10) Patent No.: US 7,526,836 B2
(45) Date of Patent: May 5, 2009

(54) HINGE WITH AN IMPROVED BOX-FASTENING ARRANGEMENT

(75) Inventor: Carlo Migli, Lecco LC (IT)

(73) Assignee: Agostino Ferrari S.p.A. (IT)

( * ) Notice: Subject to any disclaimer, the term of this patent is extended or adjusted under 35 U.S.C. 154(b) by 165 days.

(21) Appl. No.: 11/238,213

(22) Filed: Sep. 28, 2005

(65) Prior Publication Data

US 2006/0064848 A1 Mar. 30, 2006

(30) Foreign Application Priority Data

Sep. 30, 2004 (IT) ..... MI20040446 U

(51) Int. Cl.
*E05D 5/00* (2006.01)

(52) U.S. Cl. ..... 16/382; 16/384

(58) Field of Classification Search ..... 16/382, 16/383, 384, 272, 254; 411/349, 354, 15, 411/33

See application file for complete search history.

(56) References Cited

U.S. PATENT DOCUMENTS 5,577,297 A 11/1996 Lautenschlager et al.
5,607,271 A 3/1997 Salice et al.
6,279,200 B1 8/2001 Ferrari et al.
2002/0100143 A1* 8/2002 Pyo ..... 16/383

FOREIGN PATENT DOCUMENTS

DE 1959996 A1 9/1970
DE 4336326 A1 * 4/1995
DE 4414460 A1 * 11/1995
EP 1 375 801 A1 1/2004

* cited by examiner

*Primary Examiner*—Chuck Y. Mah
(74) *Attorney, Agent, or Firm*—Shlesinger & Fitzsimmons

(57) ABSTRACT

A hinge for furniture comprises a fastening box designed to be received with a central portion thereof into a hole in a piece of furniture. The box comprises two axially rotatable pins designed to be fitted into the hole together with the central portion of the box. Each pin has at least one laterally projecting tab. Working levers enable the pins to be rotated to lead the tabs to project outwardly of the box so as to interfere with the wall of the receiving hole and prevent the box from being drawn out of the hole.

10 Claims, 2 Drawing Sheets

HINGE WITH AN IMPROVED BOX-FASTENING ARRANGEMENT

BACKGROUND OF THE INVENTION

1. Field of the Invention

The present invention relates to a hinge for furniture provided with an improved box-fastening arrangement.

2. State of the Prior Art

The ironmongery market for furniture has always been sensitive to innovations enabling a quicker and steadier fastening of the ironmongery elements to the wooden panels. In particular in the case of furniture intended for the "do-it-yourself" market, the so-called "tool less" systems have been increasingly more appreciated, by means of which a safe fastening is ensured without resorting to any type of implement such as a screwdriver or a hammer.

Different technical solutions are known as well as different patents describing this type of fastening; in particular U.S. Pat. No. 6,279,200 shows a particularly cheap and efficient solution for fastening the movable part of a hinge (the box) to the door of a piece of furniture. In this embodiment, expansion of a fastening anchor is obtained by manual rotation of a flat lever partly overlapping the box flange. The embodiment shown in such a patent however has a limit, i.e. in addition to the central hole for housing the box, two side holes are required for introduction of the screw anchors and for this reason the manufacturer is obliged to carry out a type of drilling that is slightly more expensive than the most standardized drilling systems, but above all of difficult interchangeability with them.

Fastening solutions are also known in which fitting directly takes place on the walls of the central hole receiving the hinge box, this arrangement being substantially standardized and practically common to all types of hinges presently on the market.

These solutions however suffer from a relative complexity, and usually need kinematic mechanisms and/or cams producing the outwards thrust of locking jaws on the wood, in an attempt to someway exploit the idea of the screw anchor. These fastening arrangements therefore are not satisfactory.

A further aspect of the problem resides in that often known mechanisms for locking the box in the hole have only one thrust component that is radial to the hole, while an additional axial component would be advantageous to enable the box to be drawn inwardly of the hole and better adhere to the furniture surface.

It is a general aim of the present invention to obviate the above mentioned drawbacks by providing a furniture hinge provided with a fastening mechanism directly acting inside the box hole in a simple and efficient manner and, if desired, with an axial pulling component.

SUMMARY OF THE INVENTION

In view of the above aim, in accordance with the invention, a hinge for furniture has been devised which comprises a fastening box designed to be received with a central portion thereof into a hole in a piece of furniture and adapted to bear hinging, the box being provided with maneuverable members for fastening into the hole of the piece of furniture, characterized in that the fastening members comprise two axially rotatable pins disposed parallel to the fitting axis of the box in the hole and designed to be fitted into the hole together with said central portion of the box and at substantially diametrically opposite positions of the hole, each pin having at least one tab laterally projecting therefrom and an upper working lever enabling the pin to be rotated between a non-operating position of introduction and extraction of the box into and from the hole and a fastening operating position in which the tabs project outwardly of the box so as to interfere with the wall of the receiving hole and prevent the box from being drawn out of the hole itself.

BRIEF DESCRIPTION OF THE DRAWINGS

For better explaining the innovative principles of the present invention and the advantages it offers over the known art, a possible embodiment applying said principles will be described hereinafter by way of example, with the aid of the accompanying drawings. In the drawings.

DETAILED DESCRIPTION OF THE INVENTION

Figure 1:
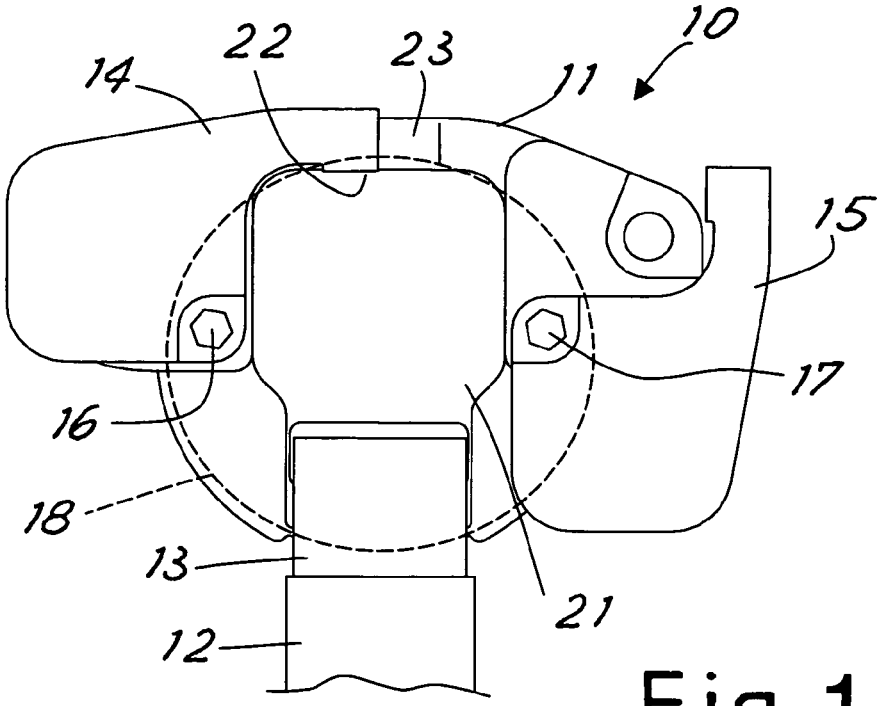
FIG. 1 is a partial diagrammatic plan view of a hinge made in accordance with the principles of the invention.

With reference to the drawings, an articulated hinge for furniture is diagrammatically shown in FIG. 1 and generally denoted at 10; it comprises a box 11 for fastening to a door and a wing or flange 12 for fastening to a shoulder or side of a piece of furniture by means of known elements, herein not shown. The box and wing are hinged with each other by means of an articulation 13. The articulation too, a four-bar linkage for example or the like, is of known type and will not be further described or shown, as it can be easily conceived by a person skilled in the art. Advantageously, the box is formed from drawn metal plate.

Disposed on the box are two working levers 14, 15 pivotally mounted at 16 and 17 respectively, on either side of the drawn central hollow 21 receiving the articulation when the hinge is in a closed position. The central portion 21 formed of the drawn plate is designed to be received in a suitable hole in the piece of furniture. The levers advantageously have an L-shaped configuration comprising mirror images of each other to match the shape of the box around the central hollow and can rotate (through an angle of approximately 90°, for example) from the rest position (shown in the figure for the right lever) to a fastening position (shown in the figure for the left lever) in which they overlap side tabs of the box.

Figure 2:
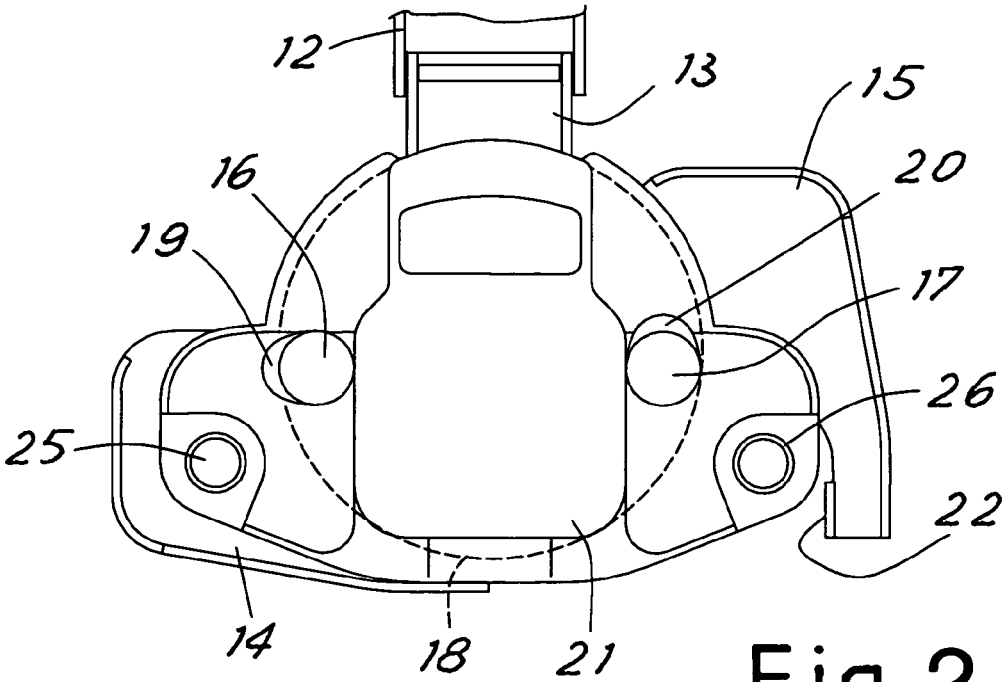
FIG. 2 is a bottom view of the hinge seen in FIG. 1.
Figure 3:
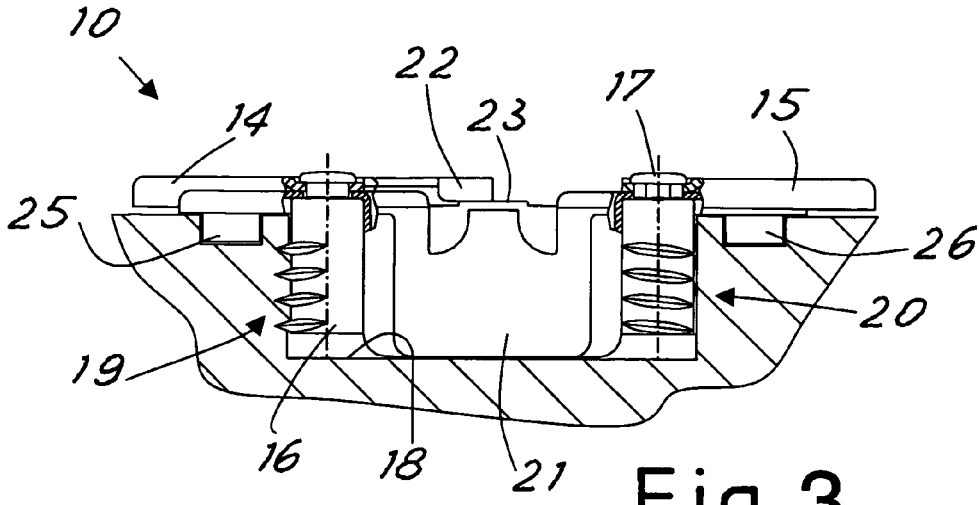
FIG. 3 shows an elevation side view of the hinge in FIG. 1.

As clearly shown in FIGS. 2 and 3, the pivot pins 16, 17 of the levers extend on the lower side of the box at either side of the drawn plate 21 so as to be disposed between the side wall of the drawn plate and the side wall of the hole (diagrammatically shown in chain line at 18 in FIG. 2), generally a blind hole, which receives the box in the piece of furniture. Advantageously, the pins bears against the side wall of the drawn plate so that said wall constitutes a reaction surface to the radial fitting thrusts to which the pins will be submitted during use.

The pins laterally have radial tabs 19, 20 that, when the corresponding lever is in the fastening position, project in the direction of the box-receiving hole 18, as shown for pin 16 in FIGS. 2 and 3, so as to interfere with the hole walls. When the lever is in the rest position (shown for pin 17) the tabs are on the contrary within the circumference inscribing the box portion that is fitted into the hole in the piece of furniture, so that they do not interfere with the walls of said hole and enable insertion or extraction of the box.

As clearly shown in FIG. 3 (where the articulation has been removed for clarity), tabs 19, 20 can consist of a group of tabs distributed along the axial extension of the respective pin, so as to furnish several fitting points in the hole wall and improve gripping. The pin is substantially as long as the height of the box that is embedded into the hole in the piece of furniture.

Advantageously, the tabs can be inclined to the pin axis in the circumferential direction of the pin (as clearly shown in FIG. 3 for tabs 20), to produce, upon rotation of the pin to the fitting position, a force with an axial component in a direction towards the hole bottom, thereby improving adhesion of the box to the surface of the piece of furniture. In other words, the tabs are advantageously helically inclined like the parts of a thread.

At this point it is apparent that the purposes of the invention are achieved. By rotating levers 14, 15, the radial tabs 19, 20 penetrate into the hole walls and fasten the box without requiring other intermediate gripping means. If the lamellar sectors forming the tabs are suitably inclined, an important pulling force is also obtained which makes fastening of the box to the furniture door still steadier.

To make fastening still safer the end portions of levers 14, 15 and the central upper surface of the box flange have been suitably designed so as to create a clip-like snap when the levers are in the closed position. For instance, as viewed from FIG. 3, the levers can have a flap 22 stepping over a relief 23 on the box and being snap-fitted thereon.

To make fastening still steadier and prevent the box from rotating around the axis of hole 18, ridges 25, 26 can be provided that project from under the box wings to be fitted into corresponding hollows in the wood.

Figure 4:
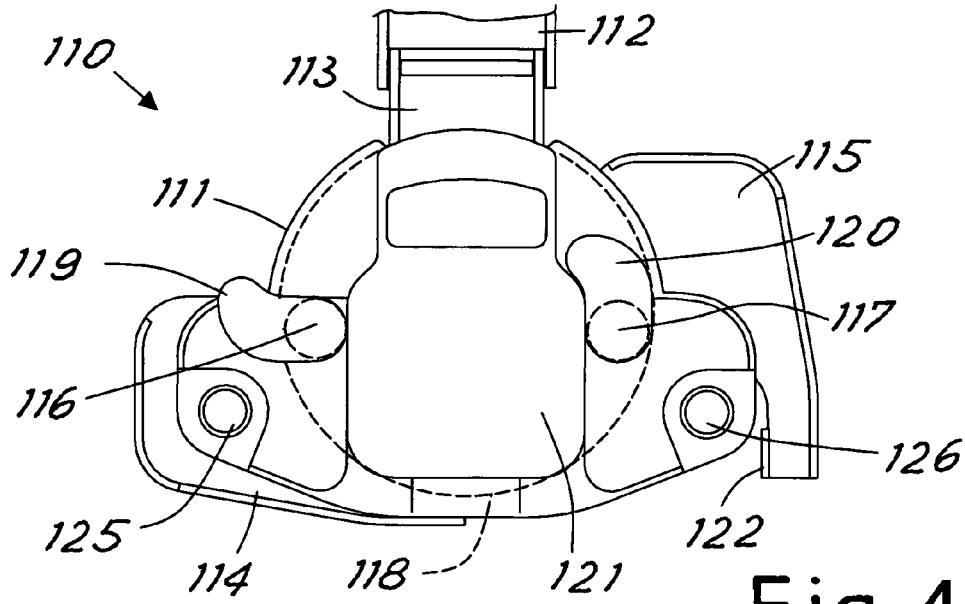
FIGS. 4 and 5 show a bottom view and an elevation side view respectively, similar to those seen in FIGS. 2 and 3 but with a different hinge embodiment, applying the principles of the present invention.
Figure 5:
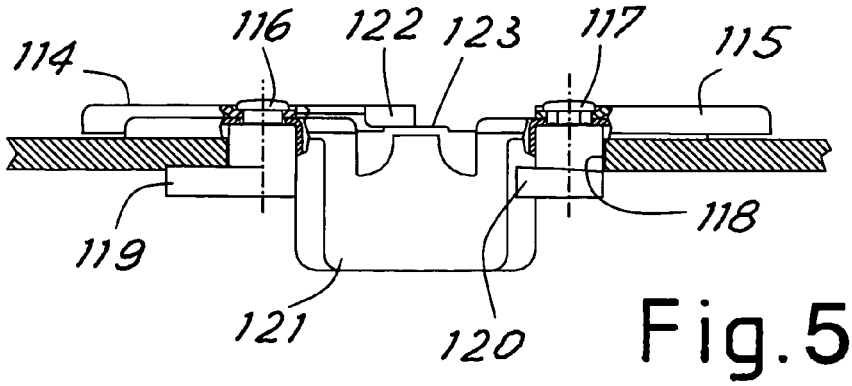

A variant is shown in FIGS. 4 and 5 and generally identified by reference numeral 110, said variant being suitable for fastening to thin walls. This embodiment is in particular useful for doors having a sandwich construction whose structure consists of two panels of relatively stiff and thin material (masonite, for example) spaced apart from each other by honeycomb-folded paperboard. The door of the above type externally appears like a normal door made of particle board, but practically it is internally hollow and all ironmongery such as handles and hinges must be fastened to the external thin panel (typically of a thickness of about 3 mm).

For the sake of clarity, elements similar to those of the preceding embodiment are allocated the same reference numerals increased by 100. Therefore there is a hinge 110 comprising a box 111 and a wing 112 that are hinged on each other by an articulation 113. Disposed on the box are two working levers 114, 115 integral with pins 116 and 117 on the two sides of the drawn central hollow 121 of the box.

In the figures, lever 115 is shown in a rest position and lever 114, rotated through about 90°, is shown in a fitted position.

Pins 116, 117 extend on the lower side of the box on either side of the drawn plate 121 (advantageously laterally bearing against the drawn wall) to enter hole 118 receiving the box.

As pins 16, 17 of the preceding embodiment, pins 116, 117 too have laterally projecting tabs for fitting into the hole. However, due to the small thickness of the wall of hole 118, the tabs are positioned under the abutment surface of the box on the wall to a distance substantially corresponding to the wall thickness so that, when rotated to an operating position, they bear on the inner face of the hole wall (instead of bearing on the side wall of the hole), as clearly shown in FIG. 5. The tab length is also sufficient to enable a steady support extending away from the hole edge to a degree sufficient to avoid yielding of the relatively thin wall.

The elongated tabs are advantageously of curved conformation (in mirror image relationship) so that in the non-operating position (shown for tab 120) they are contained within the circumference of the hole 118, this enabling insertion or extraction of the box into or from the hole. These tabs are curved in mirror image relationship, in an opposite way relative to the rotation direction towards the fastening position, so as to enable gradual insertion against the fastening wall, thereby facilitating manual rotation of the levers.

In this case therefore, fastening does not take place by interference on the inner side walls of the hole, but through clamping of the wall thickness between the fastening members 119, 120 and the bearing flange of the box.

To facilitate rotation of the levers to the fitting position and improve fastening (also advantageously providing pulling of the box to the inside of the hole), it is suitable for the upper surfaces of tabs 119 and 120 to be slightly inclined in the rotation direction, on the face turned towards the inner face of the holed wall, as shown in FIG. 5 for tab 120.

In the same manner as for the preceding embodiment, for snap-locking of the levers, flaps 122 can be provided at the lever ends for fitting on a relief 123 on the box. To make fastening still steadier and prevent the box from rotating, ridges 125, 126 can be provided that project from under the box wings to be fitted into corresponding hollows in the wood.

Obviously, the above description of an embodiment applying the innovative principles of the present invention is taken by way of example only and therefore must not be considered as a limitation of the patent rights herein claimed. For instance, the exact shape of the box, wing and hinging, as well as the related sizes can vary depending on particular requirements. In addition, the hinge can be provided with any known arrangement for adjustment of position and inclination.

What is claimed is:

1. A furniture hinge comprising a fastening box having a central portion which identifies an inscribing circumference and is designed to be fitted into a receiving hole in a piece of furniture and adapted to bear a hinging, the box extending in a direction corresponding to a direction along which the central portion of the box is designed to be fitted into a receiving hole in a piece of furniture and being provided with maneuverable fastening members for fastening the box when the central portion is in a receiving hole in a piece of furniture, wherein the fastening members comprise at least two axially rotatable pins extending parallel to said extending direction inside said inscribing circumference, adjacent to the central portion of the box and at substantially diametrically opposite positions of said central portion, and the pins extending with a free end directed towards said extending direction and laterally bearing against a side wall of said central portion of the box, each pin having at least one tab laterally projecting therefrom and an upper working lever enabling the pin to be rotated between a non-operating position allowing introduction and extraction of the central portion of the box into and from a receiving hole in a piece of furniture, in which the respective tabs are inside the inscribing circumference of the central portion of the box, and a fastening operating position in which the respective tabs project outwardly of said inscribing circumference.

2. A hinge as claimed in claim 1, wherein the at least one tab projects from the respective pins for fitting into the side wall of the receiving hole.

3. A hinge as claimed in claim 1, wherein at least one tab comprises a plurality of tabs which are spaced apart along the axial extension of the respective pin.

4. A hinge as claimed in claim 1, wherein the at least one tab is inclined to the pin axis in the circumferential direction of the pin.

5. A hinge as claimed in claim 1, wherein the at least one tab projecting from each of the at least two pins bears on the opposite surface of a wall in which the receiving hole is formed so as to entrap the wall between the at least one tab and a box region surrounding the central portion entering the receiving hole.

6. A hinge as claimed in claim 5, wherein the at least one tab has rest surfaces which are inclined in the rotation direction of the pin towards the fastening position to produce, upon rotation of the respective pin to the fastening position, a force with an axial pulling component of the box towards the inside of the receiving hole.

7. A hinge as claimed in claim 5, wherein the respective tabs of said two pins are symmetrically curved with respect to a central plane of symmetry of the hinge in a direction opposite to the rotation direction of the respective pins towards the fastening position.

8. A hinge as claimed in claim 1, wherein the two levers have an L-shaped conformation in mirror image relationship to match the upper shape of the box around a central hollow forming the portion received in the receiving hole and rotate it opposite ways with respect to each other to move from the operating position to the non-operating position, in the operating position carrying out snap-fitting on the box.

9. A hinge as claimed in claim 1, wherein the box is provided with rotation-preventing ridges designed for fitting into seats formed in the piece of furniture laterally of the box-receiving hole.

10. A furniture hinge comprising a fastening box having a central portion which identifies an inscribing circumference and is designed to be fitted into a receiving hole in a piece of furniture and adapted to bear a hinging, the box extending in a direction transverse to said inscribing circumference corresponding to a direction along which the central portion of the box is designed to be fitted into a receiving hole in a piece of furniture and being provided with maneuverable fastening members for fastening the box when the central portion is in a receiving hole in a piece of furniture, wherein the fastening members comprise at least two axially rotatable pins extending parallel to said extending direction inside said inscribing circumference, adjacent to the central portion of the box and at substantially diametrically opposite positions of said central portion, and the pins extending with a free end directed towards said extending direction, each pin having one tab laterally projecting from a portion of the pin corresponding to said free end and an upper working lever enabling the pin to be rotated between a non-operating position allowing introduction and extraction of the central portion of the box into and from a receiving hole in a piece of furniture, in which the respective tabs are inside the inscribing circumference of the central portion of the box, and a fastening operating position in which the respective tabs project outwardly of said inscribing circumference, the one tab projecting from the respective pin at a distance, from a box region surrounding said central portion, enabling the one tab to bear, when in use, on an opposite surface of a wall of a piece of furniture in which a receiving hole is formed, so as to entrap said wall between the one tab and said box region surrounding the central portion.

* * * * *